US006927744B2

(12) United States Patent
Saito et al.

(10) Patent No.: US 6,927,744 B2
(45) Date of Patent: Aug. 9, 2005

(54) ANTENNA STRUCTURE OF MOBILE COMMUNICATION DEVICE AND MOBILE COMMUNICATION DEVICE HAVING THE SAME ANTENNA STRUCTURE

(75) Inventors: Tetsuya Saito, Saitama (JP); Keiji Ogawa, Saitama (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/218,619

(22) Filed: Aug. 15, 2002

(65) Prior Publication Data

US 2003/0043080 A1 Mar. 6, 2003

(30) Foreign Application Priority Data

Aug. 28, 2001 (JP) ..... 2001/257134

(51) Int. Cl.[7] ..... H01Q 1/24
(52) U.S. Cl. ..... 343/895; 343/702
(58) Field of Search ..... 343/702, 895, 343/900, 901

(56) References Cited

U.S. PATENT DOCUMENTS

| | | | | |
|---|---|---|---|---|
| 4,435,713 A | * | 3/1984 | Gasparaitis et al. | 343/702 |
| 5,572,223 A | | 11/1996 | Phillips et al. | 343/702 |
| 5,859,617 A | | 1/1999 | Fujikawa | 343/702 |
| 6,011,524 A | * | 1/2000 | Jervis | 343/895 |
| 6,266,018 B1 | * | 7/2001 | Otomo | 343/702 |
| 6,268,836 B1 | * | 7/2001 | Faulkner et al. | 343/895 |
| 6,340,955 B1 | * | 1/2002 | Chao | 343/895 |

FOREIGN PATENT DOCUMENTS

| | | |
|---|---|---|
| CN | 1251948 A | 5/2000 |
| CN | 1252629 A | 5/2000 |
| EP | 0 986 131 A2 | 3/2000 |
| JP | 7-177053 | 7/1995 |
| JP | 8-316724 | 11/1996 |
| JP | 9-232836 | 9/1997 |
| JP | 09-232836 | 9/1997 |
| JP | 10-107526 | 4/1998 |
| JP | 10-190330 | 7/1998 |
| JP | 2001-358523 | 12/2001 |
| WO | WO 02/33788 A1 | 4/2002 |

OTHER PUBLICATIONS

Chinese Office Action dated Nov. 28, 2003.
English translation of Chinese Office Action.

* cited by examiner

*Primary Examiner*—James Vannucci
(74) *Attorney, Agent, or Firm*—Whitham, Curtis & Christofferson P.C.

(57) ABSTRACT

An antenna 10*a* equipped on a mobile communication device 1 includes a helical antenna 12 protruding from a casing 2 (key side casing portion 4) of the mobile communication device 1 and a cap 13 covering a surface of the helical antenna 12 and is constructed such that degradation of antenna gain of the helical antenna 12 due to contact of a finger 100 with the helical antenna is prevented by increasing a distance between an outer peripheral surface of the cap 13 and a surface of the helical antenna 12 to at least 1.00 mm by increasing a wall thickness of the cap 13.

13 Claims, 14 Drawing Sheets conventional distance

| distance (mm) | improvement (dB) |
|---|---|
| 0.67 | 0 |
| 1.17 | + 1.47 |
| 1.67 | + 2.88 |
| 2.67 | + 3.98 |
| ⋮ | ⋮ |

FIG.3

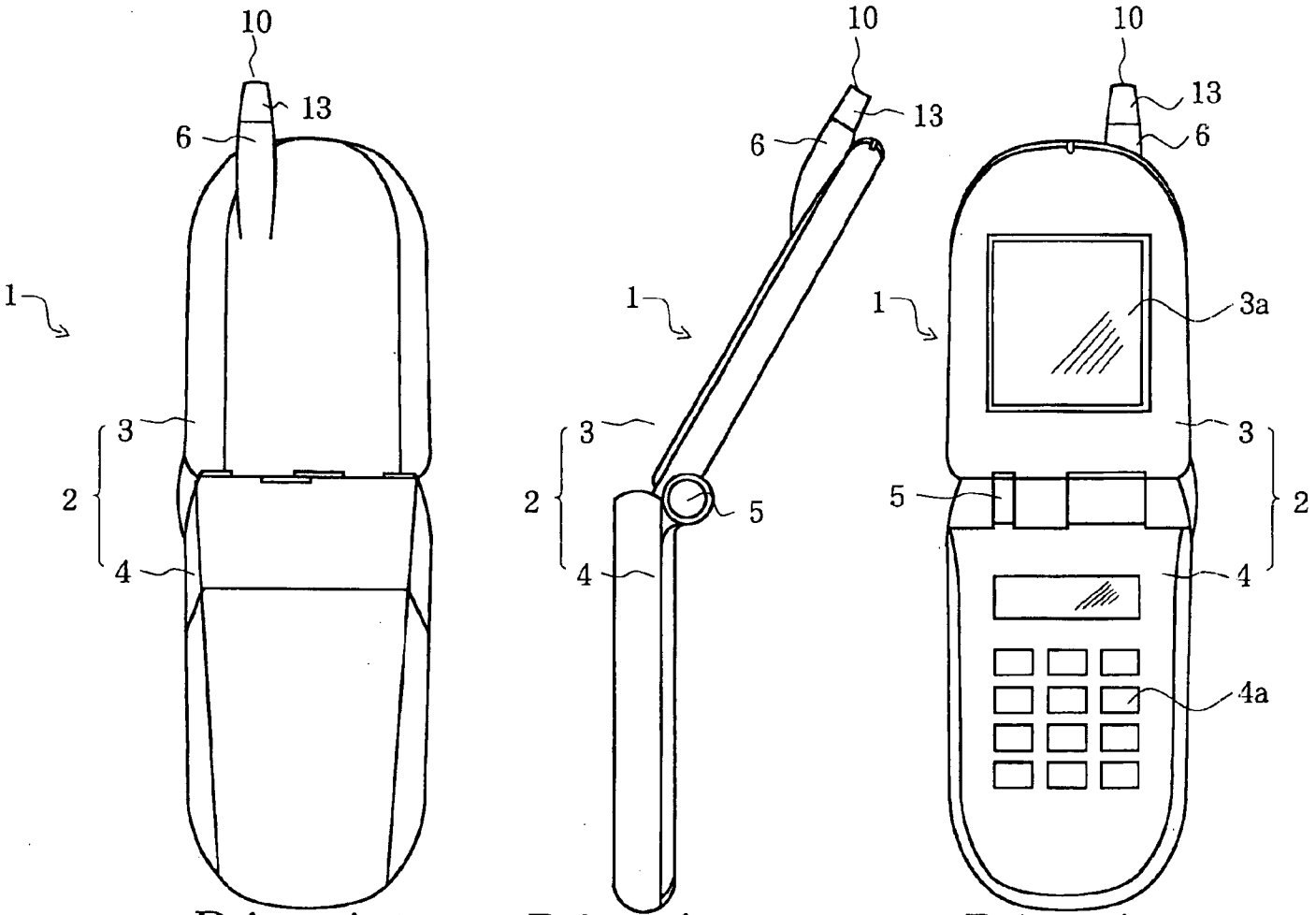
Prior Art FIG.10a
Prior Art FIG.10b
Prior Art FIG.10c

ANTENNA STRUCTURE OF MOBILE COMMUNICATION DEVICE AND MOBILE COMMUNICATION DEVICE HAVING THE SAME ANTENNA STRUCTURE

BACKGROUND OF THE INVENTION

1. Field of the Invention

The present invention relates to an antenna structure for use in a mobile communication device exemplified by a telephone terminal of a cellular system or a digital cordless telephone system. The present invention relates particularly to an antenna structure for use in a mobile communication device, which is capable of obtaining good antenna gain without degradation thereof even if a finger, etc., of a user is in contact with an antenna portion of the mobile communication device by means of a structure with which a large distance can be provided between the antenna portion protruding from a casing of the communication device and a surface of a cap covering the antenna portion. The present invention further relates to a mobile communication device having the same antenna structure.

2. Description of Related Art

In general, a mobile communication device exemplified by a telephone terminal of a cellular system or a digital cordless telephone system, etc., includes a portable casing and an antenna provided thereon for transmitting/receiving an electromagnetic wave.

A typical example of a conventional mobile communication device and an antenna structure thereof will be described with reference to FIG. 10*a* to FIG. 11*b*.

FIG. 10*a*, FIG. 10*b* and FIG. 10*c* show an outer appearance of the conventional mobile communication device in which FIG. 10*a* is a back side view, FIG. 10*b* is a left side view and FIG. 10*c* is a front view.

FIG. 11*a* and FIG. 11*b* are cross sectional front views of a main portion of the conventional radio communication device, illustrating a general antenna structure thereof, in which FIG. 11*a* shows a state where the antenna is retracted in a casing and FIG. 11*b* shows a state where the antenna is extended.

The conventional mobile communication device 1 shown in FIG. 10*a* to FIG. 10*b* is for example, a telephone terminal of a cellular system or a digital cordless telephone system, etc., and has a structure including a casing 2 composed of a display side casing portion 3 and a key side casing portion 4 hinged to the display side casing portion 3 to make the casing 2 foldable and housing components of the radio communication device, which are not shown, and an antenna 10 protruded externally from a surface of the casing 2 for transmitting/receiving an electromagnetic wave.

The casing 2 constitutes a body of the mobile communication device 1 and, as shown in FIG. 10*a* to FIG. 10*c*, the display side casing portion 3 having a display means 3*a* such as a liquid crystal display panel and the key side casing portion 4 having input means 4*a* such as key buttons are hinged each other by a hinge portion 5.

By hinging the display side casing portion 3 to the key side casing portion 4 in this manner, it is possible to fold the mobile communication device 1 when the latter is out of use to thereby make the whole radio communication device compact enough to easily keep it in a bag or a pocket of a jacket.

On the other hand, when the mobile communication device 1 is used, the mobile communication device can be opened by opening the casing portions 3 and 4 from each other, so that it is possible to easily perform a communication and/or a key input operation.

Such foldable casing structure, which can give superior portability and operability to the communication device, has been widely used in the compact communication devices such as telephone terminals of cellular systems or digital cordless telephone systems.

An antenna mounting portion 6 extending into the casing 2 is formed on an upper edge side of the display side casing portion 3 of the casing 2 and an antenna 10 is mounted in the antenna mounting portion 6.

As shown in FIG. 11*a* and FIG. 11*b*, the antenna 10 includes a whip antenna 11, a helical antenna 12, a cap 13 and a feeding portion 15.

The whip antenna 11 is a rod antenna provided inside the display side casing portion 3 of the casing 2.

The whip antenna 11 is constituted with a flexible antenna element in the form of a conductive wire and an insulating member covering a surface of the flexible antenna element and can selectively extensible externally of the casing through the antenna mounting portion 6 and the feeding portion 15.

The helical antenna 12 is arranged on a top end of the whip antenna 11.

The helical antenna 12 is insulated from the whip antenna 11 and is always protruded externally of the display side casing portion 3 with an assistance of the antenna mounting portion 6 as a stopper.

The cap 13 is formed of an insulating material and covers the surface of the helical antenna 12.

The insulating material of the cap 13 is usually a synthetic resin such as ABS resin.

The feeding portion 15 is a cylindrical metal member and is screwed inside the antenna mounting portion 6 formed on the upper end of the display side casing portion 3 as shown in FIG. 11*a*.

The antenna 10 is fixedly mounted on the casing portion 3 by screwing the feeding portion 15 into the antenna mounting portion 6.

In the state where the antenna is retracted, the feeding portion 15 becomes in contact with a bottom surface of the helical antenna 12 (see FIG. 11*a*) and, in the state where the antenna is extended, the feeding portion 15 becomes in contact with a lower end portion of the whip antenna 11 (see FIG. 11*b*), so that the antennas 11 and 12 operate with using these contact points as feeding points thereof, respectively.

More specifically, when the antenna is retracted, the bottom surface of the helical antenna 12 protruding from the display side casing portion 3 is in contact with the feeding portion 15 as shown in FIG. 11*a*, so that the helical antenna 12 works as an antenna of the mobile communications device 1.

On the other hand, when the antenna is extended, the lower end of the whip antenna 11 is in contact with the feeding portion 15 as shown in FIG. 11*b*, so that the whip antenna 11 works as the antenna of the mobile communication device 1.

Therefore, when the mobile communication device 1 is a telephone terminal of a cellular system using a frequency band of 800 MHz (or 1.5 GHz), the helical antenna 12 of the terminal in the state where the antenna is retracted and the helical antenna 12 is in contact with the feeding portion 15 operates as an antenna resonating at 800 MHz (or 1.5 GHz)

and the whip antenna 11 in the antenna extended state in which the whip antenna is in contact with the feeding portion 15 operates as an antenna resonating at 800 MHz (or 1.5 GHz).

When the mobile communication device 1 is a telephone terminal of a digital cordless telephone system using a frequency band of 1.9 GHz, the helical antenna 12 in the retracted state of the antenna of the terminal operates as an antenna resonating at 1.9 GHz and the whip antenna 11 in the antenna extended state operates as an antenna resonating at 1.9 GHz.

As described, in the conventional antenna structure of a mobile communication device, the extensible whip antenna and the helical antenna can be used in the retracted or extended state of the antenna and it is possible to perform radio communication by means of the helical antenna protruding from the casing even in the retracted state of the antenna in which the whip antenna is not extended.

Such antenna structure of the mobile communication device is disclosed in, for example, JPH8-316724A.

Besides, with recent expeditious development of the data communication technology exemplified by the Internet, the mobile communication device can have not only the conventional function of telephonic communication but also the transmission/receiving function of data such as document data and/or image data and there have been demands of increase of the size of a liquid crystal display portion for displaying the document data and the image data and improvement of the performance of the liquid crystal display portion.

However, since the antenna structure of the conventional mobile communication device is arranged on the display side casing portion as described previously (see FIG. 10*a* to FIG. 10*c*), an arrangement of display means such as a liquid crystal display portion provided on the side of the display side casing portion is restricted by the existence of the antenna, so that there is provided a problem that the increase of the size of the display means and the improvement of performance thereof are restricted.

In order to solve the problem of the mobile communication device having the antenna structure on the display side casing portion to thereby make the increase of the size of the display means on the side of the display side casing portion and the improvement of the performance thereof possible, a mobile communication device having an antenna structure on a key side casing portion of a foldable casing has been provided.

FIG. 12*a* to FIG. 12*c* show an outer configuration of such mobile communication device having an antenna structure on a key side casing portion of a foldable casing in which FIG. 12*a* is a back side view thereof, FIG. 12*b* is a left side view thereof and FIG. 12*c* is a front view thereof.

As shown in these figures, the mobile communication device 1 has a foldable casing 2 including a display side casing portion 3 and a key side casing portion 4 hinged to the display side casing portion 3 and an antenna 10 provided on the side of the key side casing portion 4.

Incidentally, a construction of the mobile communication device 1 other than the antenna 10 is similar to that of the conventional mobile communication device shown in FIG. 10*a* to FIG. 11*b*.

In the antenna structure in which the antenna 10 is provided on the side of the key side casing portion 4, it is possible to concentrically arrange a substrate in the key side casing portion 4 of the foldable casing and to use the display side casing portion 3 as dedicated to a liquid crystal display portion 3*a*.

Therefore, it becomes possible to make the size of display means such as the liquid crystal display portion 3*a* on the side of the display side casing portion 3 as large as possible and improve the performance thereof as much as possible. Consequently, it is possible to provide a radio communication device having display means capable of displaying document data and/or image data on a large display screen with high image quality.

Further, by employing the structure in which the antenna 10 is arranged on the side of the key side casing portion 4, it is possible to provide a radio communication device having a new design different from that of the conventional radio communication device 1 in which the antenna 10 protrudes from the upper end of the display side casing portion 3.

However, in the mobile communication device having the described antenna structure, which is arranged on the side of the key side casing portion, the helical portion of the antenna protrudes from in the vicinity of the hinge portion between the casing portions 3 and 4. Therefore, there is a problem that a user may touch the cap portion of the helical portion with his finger. In such case, gain of the antenna is degraded when the user performs a communication without extending the antenna.

This problem of the antenna structure in which the antenna is arranged on the side of the key side casing portion will be described in more detail with reference to FIG. 13 and FIG. 14.

FIG. 13 illustrates a case where the user holds the mobile communication device having the antenna structure shown in FIG. 12*a* to FIG. 12*c* provided on the side of the key side casing portion.

Further, FIG. 14 is a cross-sectioned front view of a main portion of the antenna structure of the mobile communication device shown in FIG. 12*a* to FIG. 12*c*.

As shown in these figures, in the mobile communication device 1 having the antenna structure provided on the side of the key side casing portion 4 of the foldable casing 2 (FIG. 12*a* to FIG. 12*c*), the helical portion 12 and the cap 13 of the antenna 10 protrude from in the vicinity of the hinge portion 5 of the casing 2.

Therefore, when the user opens the casing 2 in order to use the mobile communication device 1, the user usually holds the key side casing portion 4. Consequently, his finger 100 may touch the surface of the cap portion 13 of the antenna 10 as shown in FIG. 13.

Therefore, when he uses the device without extending the antenna 10, transmission/receiving of electromagnetic wave through the helical portion 12 while his finger 100 touching the cap 13.

The helical portion 12 of the antenna 10 is covered by the cap 13 formed of synthetic resin, etc., and a wall thickness of the cap 13 is usually around 0.60 mm.

Therefore, when the finger 100 touches the surface of the helical portion 13, a distance d between the finger 100 and the helical portion 12 becomes 0.60 mm, which is equal to the wall thickness of the cap 13, as shown in FIG. 14.

If the distance d between the finger 100 and the helical portion 12 becomes about 0.60 mm, the antenna pattern and the antenna impedance of the antenna 10 are varied, and the electromagnetic wave is blocked by the finger 100, causing antenna gain to be degraded.

Therefore, in the mobile communication device 1 having the antenna 10 provided on the side of the key side casing portion 4 of the foldable casing 2, it is impossible to obtain good antenna gain. This problem is a fatal blow for the radio communication device.

On the other hand, the existence of the antenna of the conventional antenna structure in which the antenna is arranged on the side of the display side casing portion may constitute an obstacle to the display means for displaying image and/or document data, so that it becomes difficult to provide display means concomitant with the recent development of the data communication.

Therefore, a mobile communication device having an antenna arranged on the side of the key side casing portion and being free from degradation of antenna gain even when a user's finger, etc., touches the antenna structure and an antenna structure are strongly requested.

SUMMARY OF THE INVENTION

The present invention is proposed in order to solve the problems of the conventional technique and has an object to provide an antenna structure of a mobile communication device such as a mobile telephone terminal which an antenna portion protrudes from in the vicinity of a folding portion of a foldable casing thereof and a finger, etc., of a user tends to touch the antenna portion. According to the antenna structure, a distance between the antenna portion of the antenna structure, which protrudes from the casing of the radio communication device, and a surface of a cap covering the antenna portion can be made large, so that it is possible to obtain good antenna gain without degradation even when the finger touches the antenna portion.

Another object of the present invention is to provide a mobile communication device having the same antenna structure.

In order to achieve the above objects, an antenna structure for use in a mobile communication device such as a telephone terminal of a cellular system or a digital cordless telephone system, according to a first aspect of the present invention, comprises an antenna portion protruding from a foldable casing of the mobile communication device and a cap covering a surface of the antenna portion, wherein degradation of antenna gain of the antenna portion is prevented by increasing a distance between an outer peripheral surface of the cap and the surface of the antenna portion.

In the antenna structure of the mobile communication device according to a second aspect of the present invention, the distance between the outer peripheral surface of the cap and the surface of the antenna portion is at least 1.00 mm.

According to this antenna structure of the mobile communication device of the present invention, in which the distance between the outer peripheral surface of the cap and the surface of the antenna portion protruding from the surface of the casing is at least 1.00 mm, it is possible to keep the distance of at least 1.00 mm between the finger, etc., of the user and the antenna portion even when the finger touches the outer peripheral surface of the cap.

Therefore, it is possible to restrict variation of antenna pattern and/or antenna impedance even when the finger approaches or touches the antenna portion. Further, since a relatively large distance is provided between the finger and the antenna portion, electromagnetic wave transmitted or received by the antenna portion is not blocked by the finger, so that it is possible to prevent degradation of the antenna gain.

For example, it is possible to improve the antenna gain by 1.00 dB or more compared with the conventional antenna structure in which the distance between the finger and the antenna portion becomes as short as about 0.60 mm.

More specifically, the distance between the outer peripheral surface of the cap and the surface of the antenna portion can be increased by the following construction of the antenna structure.

First, in the antenna structure of the mobile communication device according to a third aspect of the present invention, the distance between the outer peripheral surface of the cap and the surface of the antenna portion can be increased by increasing a wall thickness of the cap.

In the antenna structure according to a fourth aspect of the present invention, the distance between the outer peripheral surface of the cap and the surface of the antenna portion can be increased by partially increasing the wall thickness of the cap.

In the antenna structure according to a fifth aspect of the present invention, the wall thickness of the cap is partially increased by forming a portion or whole portion of the surface of the cap irregularly.

In the antenna structure according to a sixth aspect of the present invention, the wall thickness of the cap is partially increased by tapering the antenna portion such that it is widened toward a root portion thereof.

On the other hand, in the antenna structure according to a seventh aspect of the present invention, the distance between the outer peripheral surface of the cap and the surface of the antenna portion is increased by providing a space between an inner peripheral surface of the cap and the surface of the antenna portion.

According to any of the described antenna structures of mobile communication device of the present invention, it is possible to provide the distance of at least 1.00 mm between the surface of the antenna portion protruding from the surface of the casing and the outer peripheral surface of the cap.

Therefore, variation of antenna pattern and/or antenna impedance is restricted and an electromagnetic wave transmitted or received by the antenna portion is not blocked even when the finger of a user touches the outer peripheral surface of the cap, so that it is possible to prevent degradation of antenna gain.

In the antenna structure according to an eighth aspect of the present invention, the cap is composed of an inner cap portion covering the surface of the antenna portion and an outer cap portion covering a portion or whole portion of a surface of the inner cap portion.

According to the latter antenna structure of the mobile communication device of the present invention, in which the cap portion covering the cap directly covering the antenna portion is provided, it is possible to increase the distance between the surface of the antenna portion protruding from the surface of the casing and the outer peripheral surface of the cap.

Therefore, it is possible to realize a low cost and widely usable antenna structure by merely providing the outer cap portion covering the cap of the antenna of, for example, the existing mobile communication device, without necessity of complicated fabrication steps and parts dedicated thereto.

According to a ninth aspect of the present invention, the outer cap portion is detachably mounted on the inner cap portion.

In the antenna structure according to the ninth aspect of the present invention, in which the outer cap portion is detachably mounted on the inner cap portion, it is possible to easily remove the outer cap portion.

Therefore, it is possible to arbitrarily select or change the outer cap portion, which protrudes externally from the casing and determines an outer appearance of the antenna portion. By preparing outer cap portions having different configurations, colors and/or patterns, the user can select or change the outer appearance of the antenna arbitrarily, so that it is possible to provide an antenna structure, which is usable widely and is a valuable article of commerce.

In the antenna structure according to a tenth aspect of the present invention, the antenna portion constitutes a portion of a rod antenna, which is received in the casing of the mobile communication device and extensible therefrom.

The antenna structure of the mobile communication device constructed as mentioned above can be applied to the antenna composed of the extensible whip antenna portion and the helical antenna portion, which is usually used in a telephone terminal of a cellular system or a digital cordless telephone.

Further, the antenna structure of the present invention is also applicable to an antenna having any structure, provided that the antenna includes an antenna portion protruding from a casing thereof externally. For example, the antenna structure of the present invention is applicable to an antenna, which includes not an extensible rod antenna portion but only a helical portion protruding from a casing.

According to an eleventh aspect of the present invention, a mobile communication device includes the antenna structure according to any of the first to tenth aspects mentioned above.

More specifically, the mobile communication device according to the eleventh aspect of the present invention comprises a portable casing and an antenna structure provided in the casing, for transmitting/receiving an electromagnetic wave, the antenna structure including an antenna portion protruding from the casing and a cap covering a surface of the antenna portion wherein degradation of antenna gain of the antenna portion is prevented by increasing a distance between an outer peripheral surface of the cap and the surface of the antenna portion.

In the mobile communication device according to a twelfth aspect of the present invention, the distance between the outer peripheral surface of the cap and the surface of the antenna portion is at least 1.00 mm.

In the mobile communication device according to a thirteenth aspect of the present invention, the distance between the outer peripheral surface of the cap and the surface of the antenna portion is increased by increasing a wall thickness of the cap.

In the mobile communication device according to a fourteenth aspect of the present invention, the distance between the outer peripheral surface of the cap and the surface of the antenna portion can be increased by partially increasing the wall thickness of the cap.

In the mobile communication device according to a fifteenth aspect of the present invention, the wall thickness of the cap is partially increased by forming a portion or whole portion of the surface of the cap irregularly.

On the other hand, in the mobile communication device according to a sixteenth aspect of the present invention, the wall thickness of the cap is partially increased by tapering the antenna portion such that it is widened toward a root portion thereof.

In the mobile communication device according to a seventeenth aspect of the present invention, the distance between the outer peripheral surface of the cap and the surface of the antenna portion is increased by providing a space between an inner peripheral surface of the cap and the surface of the antenna portion.

In the mobile communication device according to an eighteenth aspect of the present invention, the cap is composed of an inner cap portion covering the surface of the antenna portion and an outer cap portion covering a portion or whole portion of a surface of the inner cap portion.

According to a nineteenth aspect of the present invention, the outer cap portion is detachably mounted on the inner cap portion.

In the mobile communication device according to a twentieth aspect of the present invention, the antenna portion constitutes a portion of a rod antenna, which is received in the casing of the mobile communication device and extensible therefrom.

According to the mobile communication device of the present invention, by employing the antenna structure capable of providing the distance of at least 1.00 mm between the outer peripheral surface of the cap and the surface of the antenna portion protruding from the surface of the casing, it is possible to keep a distance between the finger, etc., of the user and the antenna portion at least 1.00 mm even when the finger touches the outer peripheral surface of the cap.

Therefore, it is possible to restrict variation of antenna pattern and/or antenna impedance even when the finger approaches or touches the antenna portion. Further, since a relatively large distance is provided between the finger and the antenna portion, electromagnetic wave transmitted or received by the antenna portion is not blocked by the finger, so that it is possible to prevent degradation of the antenna gain.

In the mobile communication device according to a twenty first aspect of the present invention, the casing is foldable and the antenna portion is arranged in the vicinity of a hinge portion of the casing.

When the casing of the mobile communication is foldable and the antenna portion is arranged in the vicinity of the hinge portion of the casing as described, it is possible that one of the hinged two casing portions is used as a display side casing portion including display means such as a liquid crystal display portion for displaying image and/or document data and the other casing portion is used as a key side casing portion including input means such as key buttons. In this case, the antenna structure can be arranged on the key side casing portion.

Therefore, the display side casing portion can be used as a casing dedicated to the display means such as a liquid crystal display portion and the antenna is provided in the key side casing portion such that the antenna protrudes from in the vicinity of the hinge portion of the casing. Consequently, it is possible to obtain good antenna gain without degradation thereof even if the finger, etc., becomes in contact with the surface of the antenna.

That is, according to the mobile communication device of the present invention, by arranging the antenna structure in the key side casing portion of the foldable casing, it is possible to obtain good antenna gain without degradation thereof to thereby provide the mobile communication device having display means capable of displaying image and/or document data on a large display screen with high image quality without restriction of the display means such as liquid crystal display portion due to the existence of the antenna.

BRIEF DESCRIPTION OF THE DRAWINGS

Specific embodiments of the present invention will now be described, by way of example only, with reference to the accompanying of drawings in which:

FIG. 3 is a table showing a relation between a distance between an outer peripheral surface of a cap and a surface of a helical portion and a degree of improvement of antenna gain;

FIG. 10*a* to FIG. 10*c* show an outer configuration of a conventional mobile communication device, in which FIG. 10*a* is a back view, FIG. 10*b* is a left side view and FIG. 10*c* is a front view;

FIG. 11*a* and FIG. 11*b* are cross-sectioned front views of a main portion of an antenna structure of a mobile communication device, in which FIG. 11*a* shows a state in which an antenna is retracted and FIG. 11*b* shows a state in which the antenna is extended;

FIG. 12*a* to FIG. 12*c* show an outer configuration of a mobile communication device having an antenna arranged in the vicinity of a hinge portion of a foldable casing, in which FIG. 12*a* is a back view, FIG. 12*b* is a left side view and FIG. 12*c* is a front view.

DETAILED DESCRIPTION OF THE PREFERRED EMBODIMENTS

Preferred embodiments of the antenna structure for use in a mobile communication device and a mobile communication device having the same antenna structure will be described with reference to the accompanying drawings.

A first embodiment of an antenna structure for use in a mobile communication device and the mobile communication device equipped with the same antenna structure, according to the present invention, will be described with reference to FIG. 1 to FIG. 3.

Figure 1:
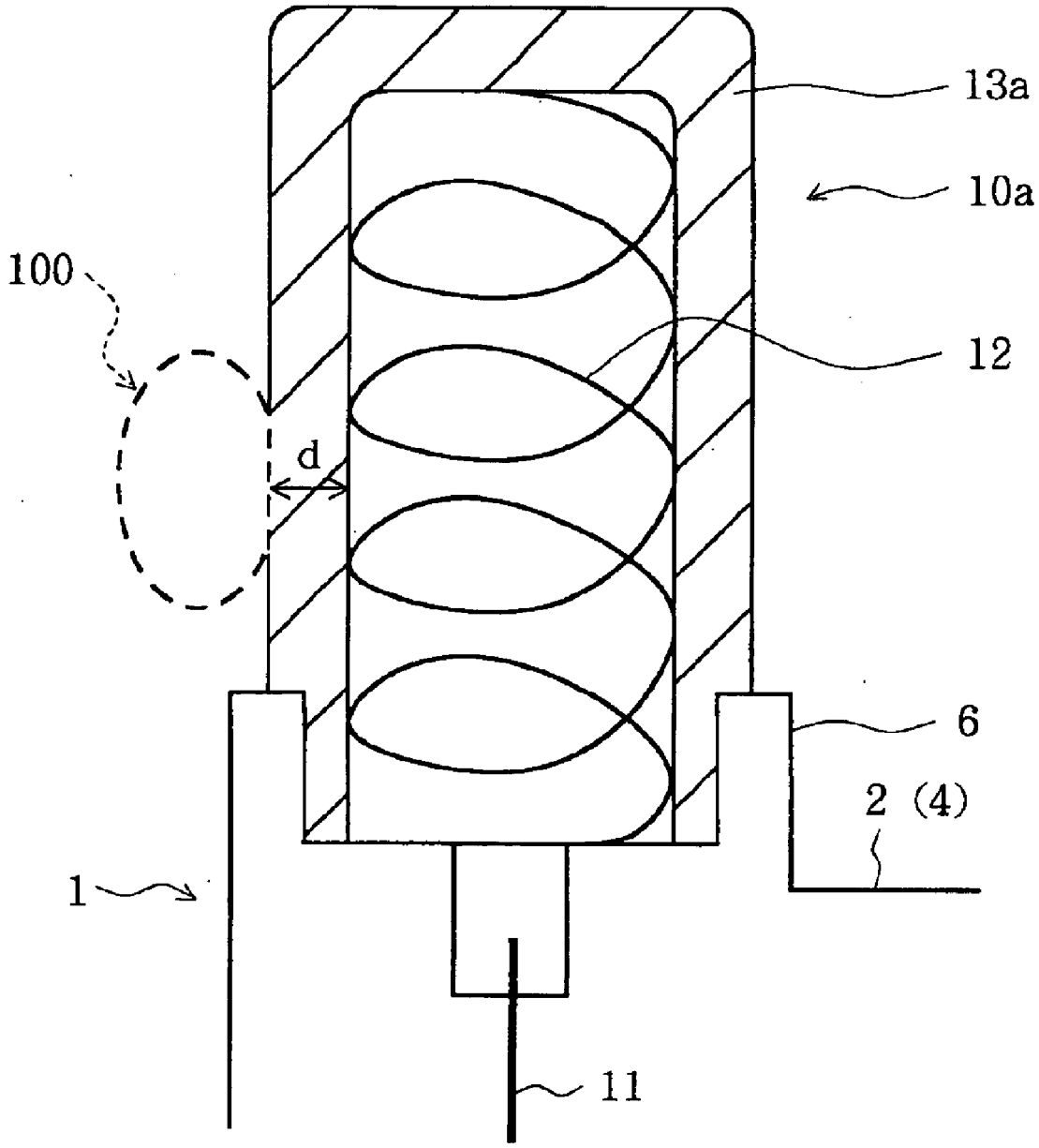
FIG. 1 is a cross-sectioned front view of a main portion of an antenna structure of mobile communication device according to a first embodiment of the present invention.

FIG. 1 is a cross-sectioned front view of a main portion of the antenna structure of the mobile communication device according to the first embodiment of the present invention.

Figure 2:
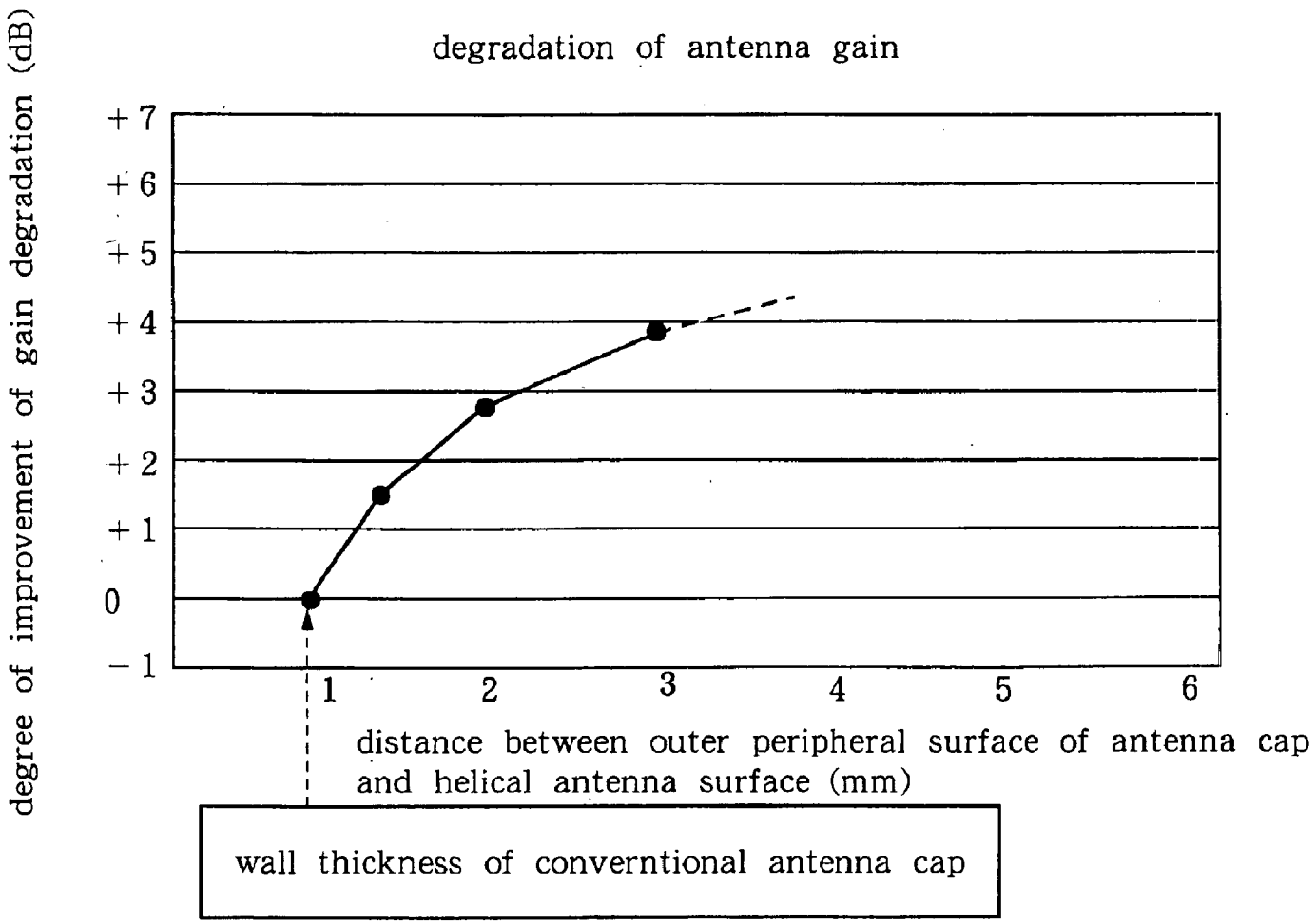
FIG. 2 is a graph showing the degree of improvement of antenna gain degradation of the antenna structure of mobile communication device according to the first embodiment of the present invention.

FIG. 2 is a graph showing an improvement of degradation of an antenna gain of the antenna structure of the mobile communication device, according to this embodiment.

FIG. 3 is a table showing a relation between a distance between an outer peripheral surface of a cap and a surface of a helical portion of the antenna structure of the mobile communication device according to this embodiment and the improvement of the antenna gain.

Constructions of the mobile communication device 1 and an antenna 10*a*, according to this embodiment, will be described with reference to FIG. 1 and FIG. 11*a* to FIG. 12*c*.

The mobile communication device 1 according to this embodiment may be a telephone terminal of a cellular system or a digital cordless telephone system, etc. The mobile communication device 1 and the antenna portion 10*a* have substantially the same constructions as those of the mobile communication device 1 and the antenna 10 shown in FIG. 11*a* to FIG. 12*c*, except a cap 13*a* of the antenna 10*a* to be described later.

More specifically, the mobile communication device 1 according to this embodiment includes a foldable casing 2 including a display side casing portion 3 and a key side casing portion 4 hinged to the display side casing portion 3. Electronic components of the radio communication device, which are not shown, are provided in the casing 2, as shown in FIG. 12*a* to FIG. 12*c* and the antenna 10*a* thereof for transmitting/receiving an electromagnetic wave is provided on a surface of the key side casing portion 4 such that it protrudes externally therefrom.

Figure 12C:
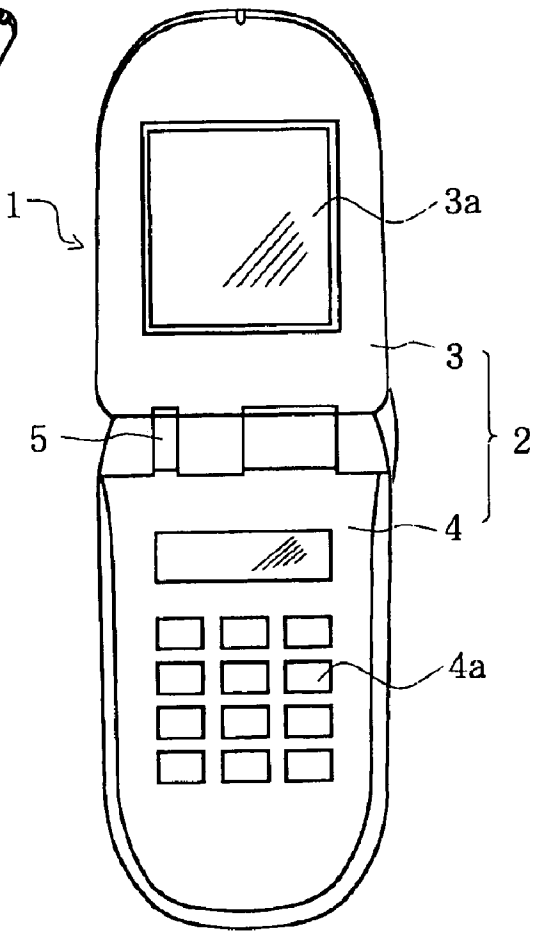
Figure 12B:
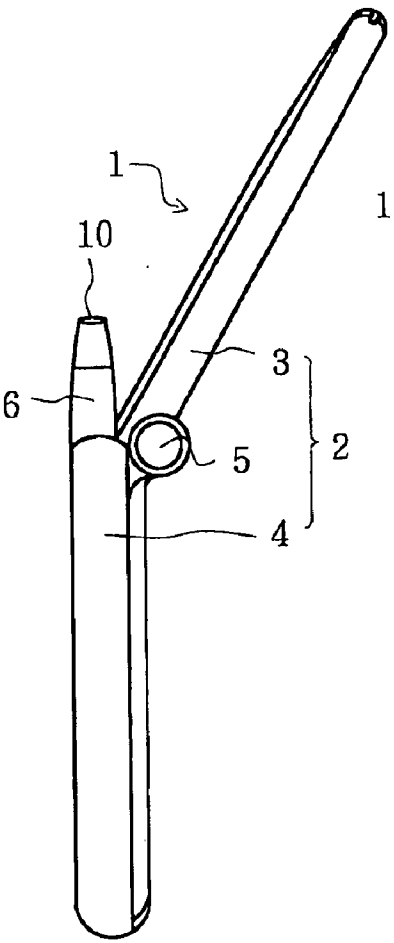
Figure 12A:
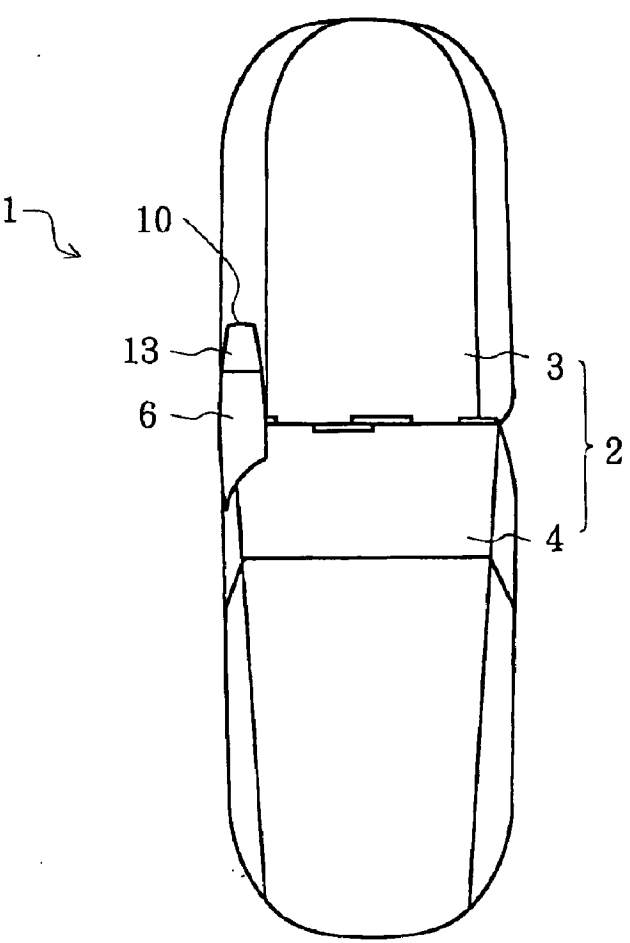
Figure 13:
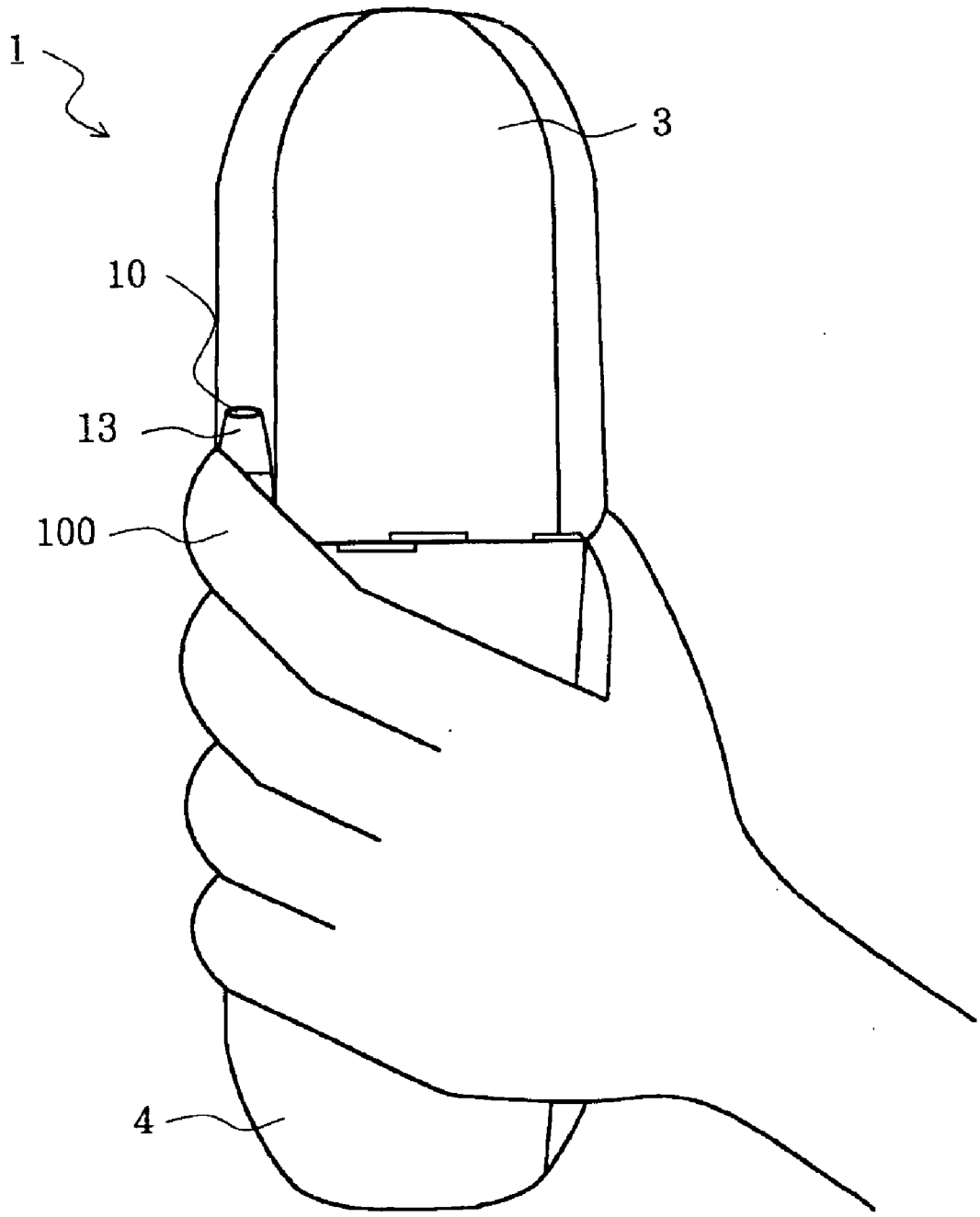
FIG. 13 illustrates the mobile communication device shown in FIG. 12*a* to FIG. 12*c* held by a hand of a user.

The foldable casing 2 constitutes a body of the mobile communication device 1 and the display side casing portion 3 having a display means 3*a* constructed with such as a liquid crystal display panel and the key side casing portion 4 having input means 4*a* such as key buttons are hinged each other through a hinge portion 5 (see FIG. 12*a* to FIG. 12*c*).

An antenna mounting portion 6 is formed on an upper edge side of the key side casing portion 4 of the foldable casing 2, that is, in the vicinity of the hinge portion 5, and the antenna 10*a* of this embodiment can be mounted on the antenna mounting portion 6.

Figure 11B:
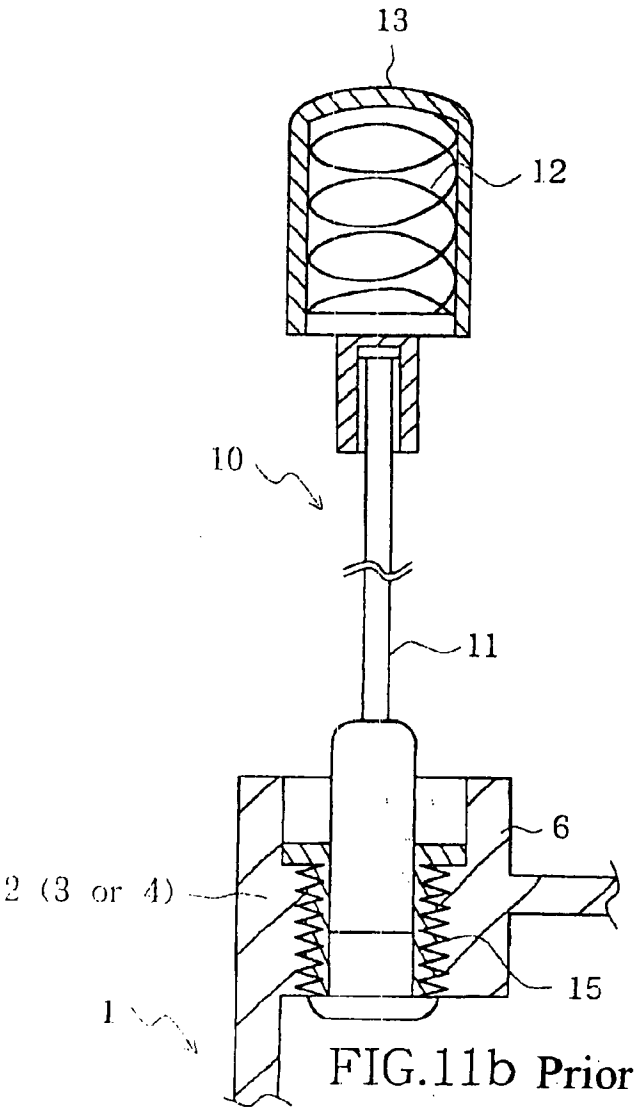
FIG.11b Prior Art
Figure 11A:
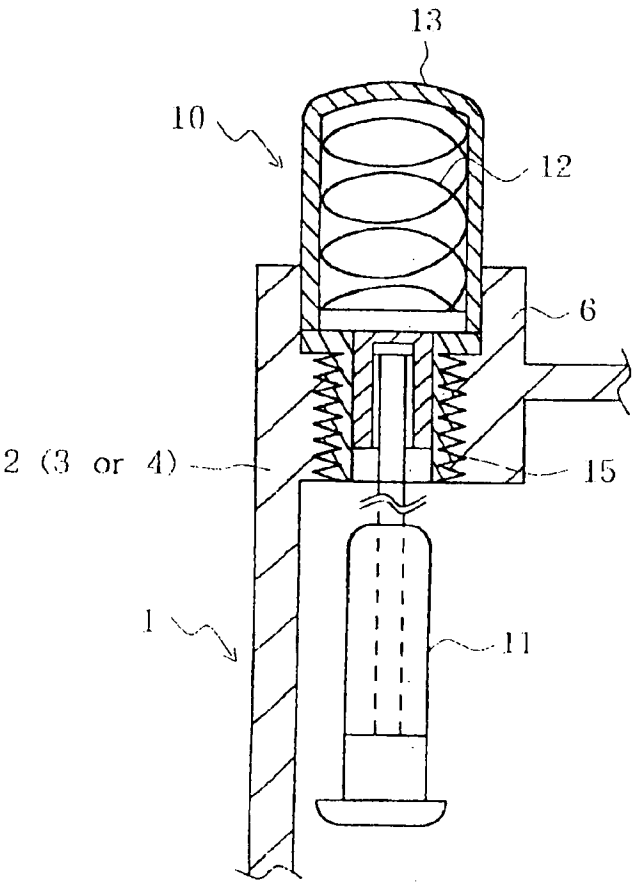
FIG.11a Prior Art

The antenna 10*a* according to this embodiment is constructed substantially similarly to the antenna 10 shown in FIG. 11*a* and FIG 11*b*, except the cap 13*a*.

More specifically, the antenna 10*a* of this embodiment includes a whip antenna 11, a helical antenna 12, the cap 13*a* covering a surface of the helical antenna 12 and a feeding portion 15 (see FIG. 11*a* and FIG. 11*b*).

The whip antenna 11 is an extensible rod antenna composed of a flexible antenna element formed by a conductor line and an insulating member covering a surface of the antenna element and is arranged inside the key side casing portion 4 of the casing 2 and extensible externally of the casing through an antenna mounting portion 6 and the feeding portion 15 (see FIG. 11*a* and FIG. 11*b*).

The helical antenna 12 includes a coil antenna element arranged on a top end of the whip antenna 11 and insulated from the whip antenna 11 and always protrudes from the key side casing portion 4 in the vicinity of the hinge portion 5 with using the antenna mounting portion 6 as a stopper (see FIG. 11*a* and FIG. 11*b*).

The cap 13*a* of this embodiment covers the surface of the helical antenna 12.

The cap 13*a* of this embodiment will be described in detail later.

The feeding portion 15 takes in the form of a cylindrical metal member and is screwed into the antenna mounting portion 6 formed on the upper end of the key side casing portion 4 of the casing 2 (see FIG. 11*a* and FIG. 11*b*).

The antenna 10 is fixedly mounted on the key side casing portion 3 of the casing 2 by screwing the feeding portion 15 in the antenna mounting portion 6.

The feeding portion 15 becomes in contact with the lower end of the whip antenna 11 when the antenna is extended and with a bottom surface of the helical antenna 12 when it is retracted, so that the feeding portion 15 becomes a feeding point for the respective antennas 11 and 12 to operate the antenna.

Therefore, in a case where the mobile communication device 1 is used as a telephone terminal of a cellular system using a frequency band of 800 MHz (or 1.5 GHz), for example, and the antenna is retracted, the helical antenna 12, which is in contact with the feeding point 15, is operated at resonance frequency of 800 MHz (or 1.5 GHz) and, when the antenna is extended, the whip antenna 11, which is in contact with the feeding point 15, is operated at 800 MHz (or 1.5 GHz).

In a case where the mobile communication device 1 is used as a telephone terminal of a digital cordless telephone system using a frequency band of 1.9 GHz, the helical antenna 12 is operated at resonance frequency of 1.9 GHz when the antenna is retracted and the whip antenna 11 is operated at 1.9 GHz when the antenna is extended.

Now, the cap 13*a* of the antenna 10*a* according to this embodiment will be described with reference to FIG. 1.

Similarly to the cap of the conventional antenna structure, the cap 13*a* covers the surface of the helical antenna 12 of the antenna 10*a* and is formed of an insulating material, which is usually of a synthetic resin such as ABS.

Incidentally, the material forming the cap 13*a* may be any provided that it is electrically insulating material. However, it is preferable to use an insulating material having high permittivity.

In this embodiment, a wall of a portion of the cap 13*a* other than a portion thereof, which is received in the antenna mounting portion 6 of the cap 13*a*, is made as thick as at least 1.00 mm, as shown in FIG. 1.

More specifically, as shown in FIG. 1, the wall thickness d of the portion of the cap 13*a*, which is outside the antenna mounting portion 6 of the key side casing portion 4 when the antenna 10*a* is retracted, is larger than that of the other portion of the cap 13*a*, which is received in the antenna mounting portion 6 (see FIG. 11*a* and FIG. 11*b*).

The wall thickness d of the outside portion of the cap 13*a* is 1.00 mm or more.

By making the wall of the cap 13*a*, which is outside the antenna mounting portion 6, as thick as 1.00 mm or more, a distance d between an outer peripheral surface of the cap 13*a* and the surface of the helical antenna 12 becomes 1.00 mm or more, as shown in FIG. 1.

Therefore, when a finger 100, etc., of a user touches the surface of the cap 13*a*, the surface of the helical antenna 12 is always separated from the finger 100 by 1.00 mm or more by the wall thickness of the cap 13*a*, as shown in FIG. 1.

A relation between the distance between the surface of the helical antenna 12 and the finger 100 and the antenna gain of the helical antenna 12 will be described with reference to FIG. 2 and FIG. 3.

Data shown in FIG. 2 and FIG. 3 were obtained by removing the cap 13*a*, touching the surface of the helical antenna 12, sequentially inserting a plurality of insulating plates having different thicknesses between the surface of the helical antenna and the finger and measuring the antenna gain for every thickness of the insulating plate.

First, it is clear from FIG. 2 that the antenna gain of the helical antenna 12 is improved correspondingly to the distance between the surface of the helical antenna 12 and the finger 100.

Figure 14:
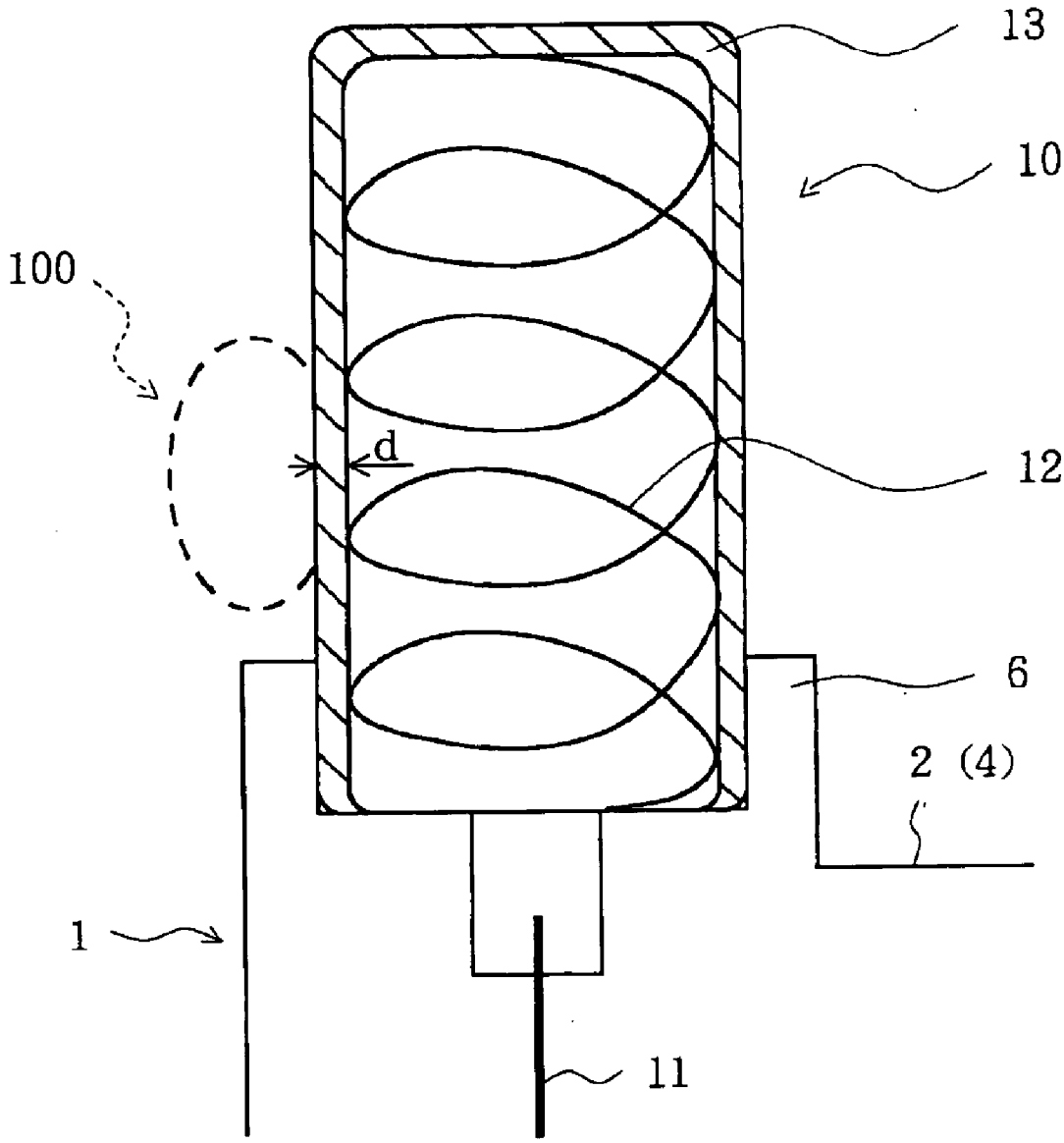
FIG. 14 is a cross-sectioned front view showing an antenna structure of a conventional radio communication device.

As shown in FIG. 3, using the antenna gain obtained in the conventional antenna structure including the cap 13 having a wall thickness of 0.67 mm corresponding to the distance d in FIG. 14 as a reference (0 dB), the antenna gain is +1.47 (1.47 dB) when the distance between the surface of the helical antenna 12 and the finger 100 is 1.17 mm, +2.88 (2.88 dB) when it is 1.67 mm, +3.98 (3.98 dB) when 2.67 mm and so on. That is, it is clear that the antenna gain is improved proportionally to the distance between the helical antenna 12 and the finger 100.

Further, as shown in FIG. 2, it is clear that, when the distance between the surface of the helical antenna 12 and the finger 100 is 1.00 mm, an improvement of antenna gain by 1.00 dB (+1.00) is obtained compared with the distance of 0.67 mm in the conventional antenna structure.

As such, when the finger 100, etc., approaches the helical antenna 12, it is possible to restrict variation of antenna pattern and/or antenna impedance by separating the helical antenna 12 from the finger by the constant distance or more by utilizing the wall thickness of the cap 13*a* to thereby prevent electromagnetic wave from being blocked by the finger and restrict degradation of the antenna gain.

That is, by separating the helical antenna 12 from the finger 100 by a distance d of at least 1.00 mm by the wall thickness of the cap 13*a*, it is possible to improve the antenna gain by 1.0 dB or more compared with the conventional antenna structure in which the distance d is about 0.6 mm.

As described, according to the antenna 10*a* of the mobile communication device of this embodiment, it is possible to provide the distance d equal to at least 1.00 mm, which is larger than that of the conventional antenna structure by about 0.4 mm, between the surface of the helical antenna 12 and the outer peripheral surface of the cap 13*a* by making the wall thickness of the cap 13*a* covering the surface of the helical antenna 12 protruding in the vicinity of the hinge portion 5 from the surface of the key side casing portion 4 of the casing 2.

Therefore, it is possible to provide the distance of 1.00 mm or more between the finger 100 and the helical antenna 12 even when the user's finger touches the outer peripheral surface of the cap 13*a* to thereby restrict variation of antenna pattern and/or antenna impedance and blockage of electromagnetic wave transmitted or received by the antenna portion and prevent degradation of the antenna gain.

Even when the antenna structure of the mobile communication device, which is foldable, has a possibility of contact of a finger 100 with the cap 13*a* due to the arrangement of the antenna 10*a* on the key side casing portion 4 and the protrusion thereof in the vicinity of the hinge portion 5 between the display side casing portion and the key side casing portion, there is no degradation of the antenna gain due to the existence of the finger, etc.

Therefore, according to this embodiment, it is possible to use the display side casing portion 3 as dedicated to the display means such as the liquid crystal display portion 3*a*, etc., and, consequently, it is possible to provide the mobile communication device 1 having the display means such as the liquid crystal display portion 3*a* for displaying image and/or document data on a large display screen with high image quality without any adverse influence of the existence of the antenna on the liquid crystal display portion, etc., which is indispensable in the conventional mobile communication device.

Incidentally, in the antenna 10*a* of this embodiment, the configuration of the cap 13*a* can be any, provided that the distance d between the outer peripheral surface of the cap 13*a* and the surface of the helical antenna 12 can be increased by increasing the wall thickness of the cap 13*a*.

For example, in the example shown in FIG. 1, an outer diameter of the portion of the cap 13*a*, which is outside the antenna mounting portion 6 of the key side casing portion 4 when the antenna 10*a* is retracted, is larger than that of the other portion thereof, which is received within the antenna mounting portion 6, so that the cap 13*a* has a stepped peripheral surface. However, a cap 13*b* having a uniform outer diameter and a uniform wall thickness throughout thereof as shown in FIG. 4 may be used in lieu of the cap 13*a*.

Figure 4:
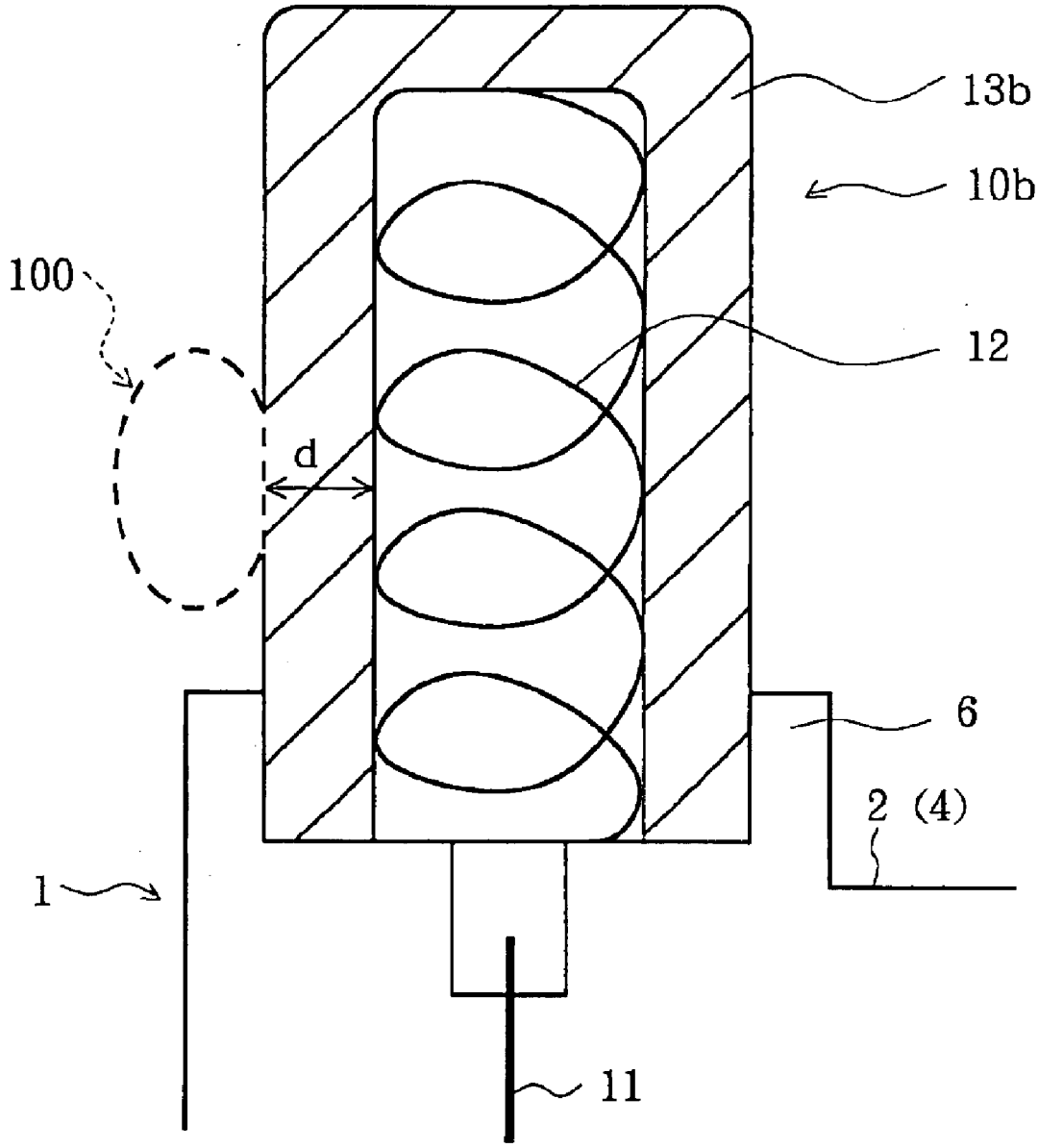
FIG. 4 is a cross-sectioned front view of a main portion of another example of the antenna structure of mobile communication device according to the first embodiment of the present invention.

The cap 13*b* shown in FIG. 4 can provide a similar effect to that obtainable by the cap 13*a* shown in FIG. 1 as to the improvement of the antenna gain, which is obtained by defining the distance d between the helical antenna 12 and the finger 100 to the constant value or more, provided that a constant wall thickness of the portion of the cap 13*b*, which is outside the antenna mounting portion 6, is provided.

Further, when a cap having a smooth cylindrical configuration with uniform outer diameter throughout thereof such as the cap 13*b* shown in FIG. 4 is used, it is possible to reduce the outer diameter thereof compared with that of the cap 13*b*, so that it is possible to provide an antenna 10*a* having different outer configuration while providing a similar effect as to the antenna gain.

In the latter case, since an inner diameter of the cap 13*b* is reduced compared with the cap 13*a*, the diameter of the coil forming the helical antenna 12 positioned within the cap 3*b* is made smaller correspondingly.

Next, a second embodiment of the mobile communication device according to the present invention will be described with reference to FIG. 5.

Figure 5:
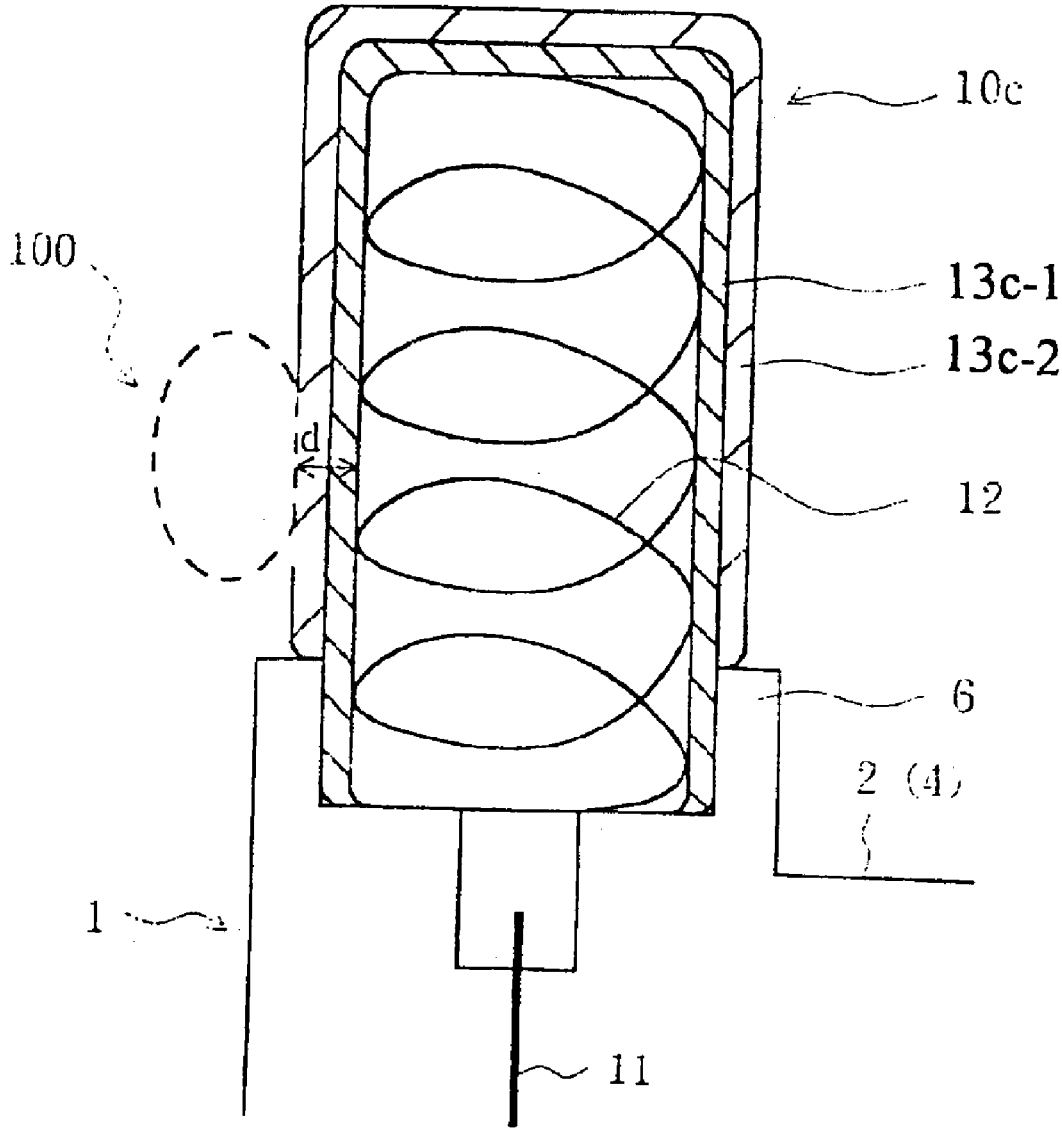
FIG. 5 is a cross-sectioned front view of a main portion of an antenna structure of mobile communication device according to a second embodiment of the present invention.

FIG. 5 is a cross sectioned front view of a main portion of the antenna structure of the mobile communication device according to the second embodiment of the present invention.

The antenna structure of the mobile communication device shown in FIG. 5 is similar to that of the described first embodiment, except that the cap 13*a* (or cap 13*b*) covering the helical antenna 12 is modified to a cap 13*c* having a double structure including an inner cap 13*c*-1 and an outer cap 13*c*-2.

Therefore, other constructive components thereof than the cap 13*c* having the double structure are similar to those of the first embodiment, respectively, and are depicted by the same reference numerals without detailed description thereof.

As shown in FIG. 5, the antenna 10*c* of this embodiment includes the cap 13*c* constructed as the double structure including the inner cap 13*c*-1 for covering a surface of the helical antenna 12 and the outer cap 13*c*-2 for covering a surface of a portion of the inner cap 13*c*-1, which is outside an antenna mounting portion 6.

A wall thickness of the cap 13*c* having the double structure is 1.00 mm or more as in the first embodiment.

In the antenna 10*c* according to this embodiment, the outer cap 13*c*-2 covering the inner cap 13*c*-1, which covers the helical antenna 12, is provided as mentioned above, to increase a distance d (see FIG. 5) between the surface of the helical antenna 12 protruding from a surface of a key side casing portion 4 and an outer peripheral surface of the cap 13*c*.

With this structure, it is possible to provide a similar effect to that obtainable by the cap 13*a* (or 13*b*) of the first embodiment as to the improvement of the antenna gain, which is obtained by defining the distance d between the helical antenna 12 and the finger 100 to the constant value or more, provided that the constant wall thickness of the portion of the cap 13*c*, which is outside the antenna mounting portion 6, is provided.

Further, according to the concept of the cap 13*c* having the double structure as mentioned, it is possible to provide the outer cap 13*c*-2 on the cap 13 of the antenna 10 of the existing mobile communication device 1 to cover the cap 13.

Since it is possible to easily and reliably embody the antenna structure according to this embodiment by merely providing an outer cap corresponding to the outer cap 13*c*-2 of the cap 13*c* on the existing cap of the existing antenna, it is possible to provide the inexpensive and widely usable antenna structure without necessity of complicated fabrication steps and parts dedicated thereto.

Incidentally, although, in this embodiment, the outer cap 13*c*-2 takes in the form of a blind cylinder covering the whole inner cap 13*c*-1 as shown in FIG. 5, the outer cap 13*c*-2 may have a configuration constructed to partially cover the inner cap 13*c*-1.

For example, the outer cap 13*c*-2 may have a cylindrical or annular configuration wrapping around the inner cap 13*c*-1, provided that at least a portion of the cap 13*c* with which the finger 100, etc., may be in contact has a double structure and the wall thickness of the portion of the cap 13*c* becomes 1.00 mm or more.

The inner cap 13*c*-1 and the outer cap 13*c*-2 may be formed of the same insulating material. Alternatively, the caps 13*c*-1 and 13*c*-2 may be formed of different insulating materials, respectively.

Further, in this embodiment, the outer cap 13*c*-2 is detachably mounted on the inner cap 13*c*-1.

According to the antenna structure having the outer cap 13*c*-2 detachably mounted on the inner cap 13*c*-1, it is possible to easily detach and change only the outer cap 13*c*-2 of the cap 13*c*.

Since the outer cap 13*c*-2 protrudes externally from the key side casing portion 4 and becomes an important factor for determining an outer appearance of the antenna 10*c*, it becomes possible to select and change the outer appearance of the antenna 10*c* on demand of a user himself by arbitrarily selecting and changing the outer cap 13*c*-2 by, for example, preparing outer caps 13*c*-2 having different configurations and/or different colors.

In such case, it is possible to provide a widely usable and commercially valuable antenna structure and mobile communication device according to the present invention.

A third embodiment of the antenna structure of the mobile communication device according to the present invention will be described with reference to FIG. 6 and FIG. 7.

Figure 6:
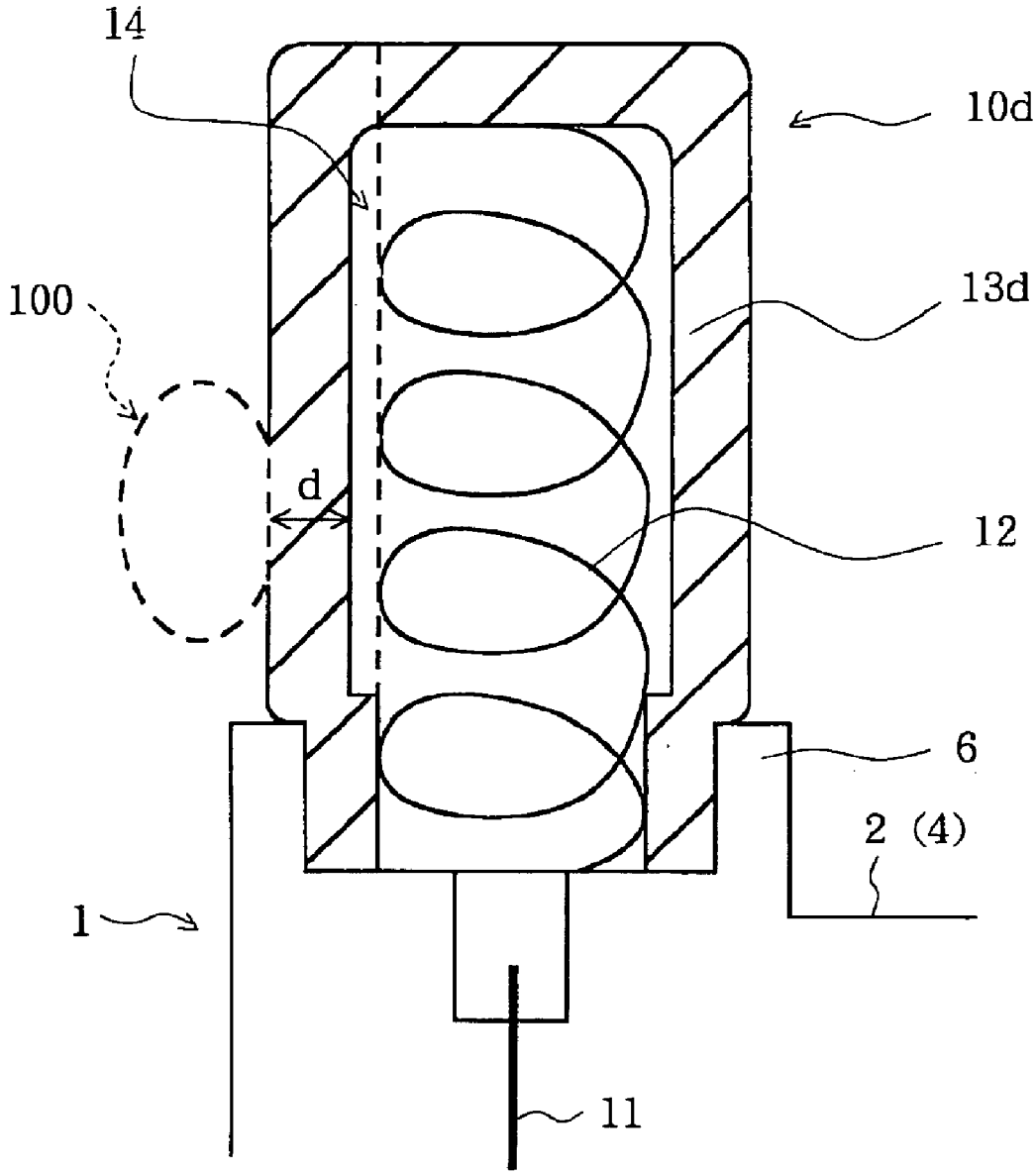
FIG. 6 is a cross-sectioned front view of a main portion of an antenna structure of mobile communication device according to a third embodiment of the present invention.

FIG. 6 is a cross-sectioned front view of a main portion of an example of the antenna structure of the mobile communication device according to the third embodiment.

Figure 7:
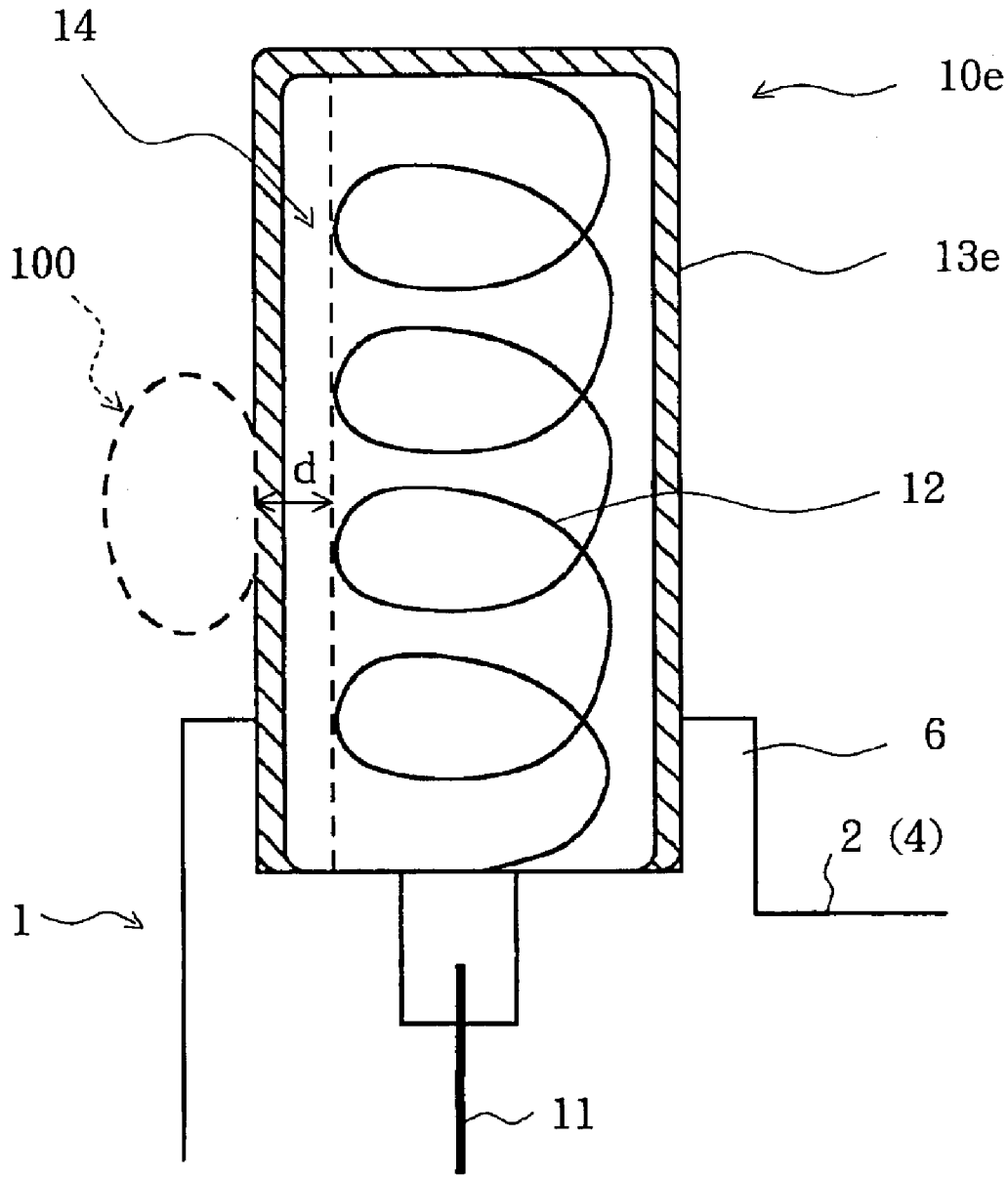
FIG. 7 is a cross-sectioned front view of a main portion of another example of the antenna structure of mobile communication device according to the third embodiment of the present invention.

FIG. 7 is a cross-sectioned front view of a main portion of another example of the antenna structure of the mobile communication device according to the third embodiment.

The antenna structures of the mobile communication device according to the third embodiment, shown in these figures, are modifications of the first embodiment described previously, in each of which a space 14 is provided between an inner peripheral surface of a cap 13 (13*d* or 13*e*) of an antenna 10 (10*d* or 10*e*) and a surface of a helical antenna 12.

A wall thickness of a portion of the cap 13 (13*d* or 13*e*) of this embodiment, which is outside an antenna mounting portion 6 is about 0.60 mm, which is substantially the same as that of the conventional antenna structure.

The helical antenna 12 having a diameter smaller than an inner diameter of the cap 13*d* (or, 13*e*) is arranged within the cap 13*d* (or 13*e*) as shown in FIG. 6 or FIG. 7 to provide the space 14 between the cap 13*d* (or 13*e*) and the helical antenna 12.

The distance d (see FIG. 6 or FIG. 7) between the outer peripheral surface of the cap 13*d* (or 13*e*) and the surface of the helical antenna 12 is maintained at 1.00 mm or more as in the first embodiment by the space 14 and the wall thickness of the cap 13*d* (or 13*e*).

Therefore, even when the user touches the surface of the cap 13*d* (or 13*e*) with his finger 100, etc., the surface of the helical antenna 12 is always separated from the finger 100 by 1.00 mm or more by the wall thickness of the cap 13*d* (or 13*e*) and the space 14.

Incidentally, in a state where the antenna 10*d* is retracted, the cap 13*d* shown in FIG. 6 is a cylindrical shape having stepped outer diameters between an upper portion thereof outside the antenna mounting portion 6 of the key side casing portion 4 and a lower portion thereof inside the antenna mounting portion 6 and the space 14 is formed inside the upper portion of the cap.

On the other hand, the cap 13*e* shown in FIG. 7 is a cylinder having a uniform outer diameter and the space 14 can be formed in the whole cap 13*e*.

In either case, since the distance d is maintained at 1.00 mm or more by the wall thickness of the upper portion of the cap, which is outside the antenna mounting portion 6, and the space 14, there is an improving effect of the antenna gain similar to that obtained in the first embodiment by the restriction of the distance d between the helical antenna 12 and the finger 100 to a constant value.

In the case of the cap 13*e* shown in FIG. 7, in which the outer configuration thereof is smooth cylindrical, the outer diameter thereof can be reduced compared with the cap 13*d*. Therefore, it is possible to provide the antenna 10*a* having different outer configuration from that of the cap 13*d*, while maintaining a similar effect in the antenna gain, similarly to the cap 13*d* (see FIG. 4).

In this case, however, the coil diameter of the helical antenna 12 positioned within the cap must be made small since the inner diameter of the cap 13*e* becomes small as in the case of the cap 13*b* of the first embodiment.

According to the cap 13*d* or the cap 13*e* of this embodiment, the distance d between the surface of the helical antenna 12 protruding from the surface of the key side casing portion 4 and the outer peripheral surface of the cap can be set at least 1.00 mm by forming the space 14 inside the cap.

Therefore, even if the user touches the outer peripheral surface of the cap 13*d* or 13*e* with his finger, variation of antenna pattern and/or antenna impedance can be restricted. Further, electromagnetic wave is not blocked by the finger, so that it is possible to prevent antenna gain from being degraded and to obtain good antenna gain.

Further, it becomes possible to reduce a weight of the cap 13*d* or 13*e* by an amount corresponding to the space 14 provided therein.

Next, a fourth embodiment of the antenna structure of the mobile communication device according to the present invention will be described with reference to FIG. 8.

Figure 8:
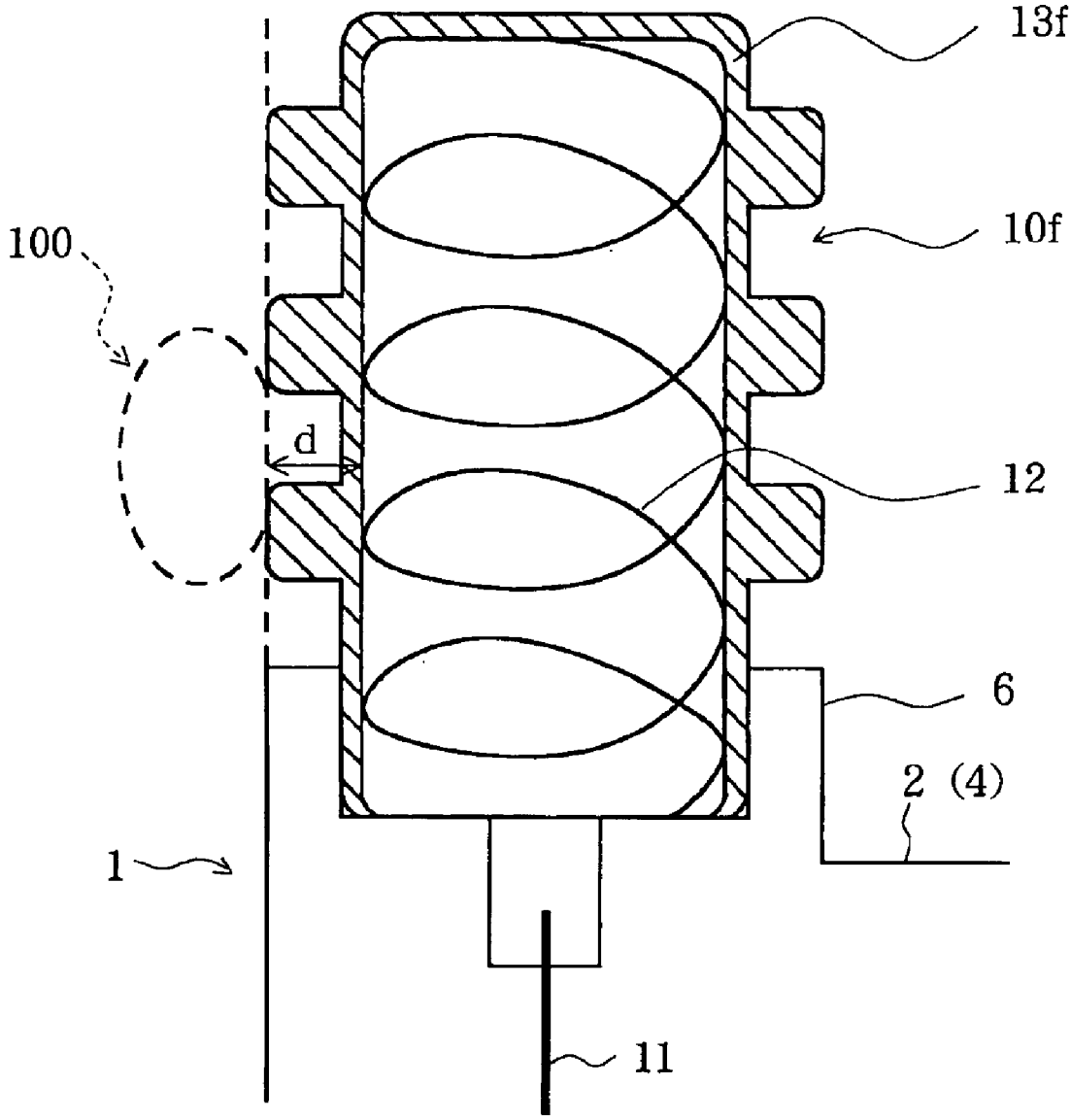
FIG. 8 is a cross-sectioned front view of a main portion of an antenna structure of mobile communication device according to a fourth embodiment of the present invention.

FIG. 8 is a cross-sectioned front view of a main portion of the antenna structure of the mobile communication device.

In the antenna structure of the mobile communication device according to this embodiment, a surface of a cap 13*f* of an antenna 10*f* is made irregular.

As shown in FIG. 8, a plurality of lands are formed on an outer peripheral surface of the cap 13*f* and the distance d between the outer surface of the cap 13*f* defined by the land portions and the surface of the helical antenna 12 is set to 1.00 mm or more as in the case of the first embodiment.

In this case, the irregularity of the outer peripheral surface of the cap 13*f* may be form by integral molding or separately prepared land portions may be rigidly bonded to a smooth peripheral surface of the cap 13*f*.

In this embodiment, however, the surface irregularity of the cap 13*f* is provided by integral molding, as shown in FIG. 8.

Alternatively, annular land portions may be formed along the outer peripheral surface of the cap 13*f*. Alternatively, a plurality of discrete land portions, which are prepared preliminary, may be implanted to the outer peripheral surface with a predetermined interval or with random interval.

According to the cap 13*f* of this embodiment constructed as mentioned above, it is possible to maintain the distance d of at least 1.00 mm between the surface of the helical antenna 12 protruding from the surface of the key side casing portion 4 and the outer peripheral surface of the cap 13*f*, which is defined by the land portions.

Therefore, even if the user touches the outer peripheral surface of the cap 13*f* with his finger 100, variation of antenna pattern and/or antenna impedance due to the finger can be restricted since the finger can be separated from the helical antenna by 1.00 mm due to the existence of the land portions. Further, electromagnetic wave is not blocked by the finger, so that it is possible to prevent antenna gain from being degraded and to obtain good antenna gain.

Further, according to the antenna structure in which the surface of the cap is made irregular in the described manner, there is provided an effect that the weight of the cap 13*f* is reduced by an amount correspondingly to a weight of the recessed portions thereof.

Further, according to the cap 13*f* having the irregular surface, it is possible to use such surface irregularity as decorative pattern determining the outer appearance of the antenna 10*f*, so that it is possible to improve the freedom of design of the antenna 10*f* to thereby provide an antenna structure having an attractive outer appearance.

A fifth embodiment of the antenna structure of the mobile communication device according to the present invention will be described with reference to FIG. 9.

Figure 9:
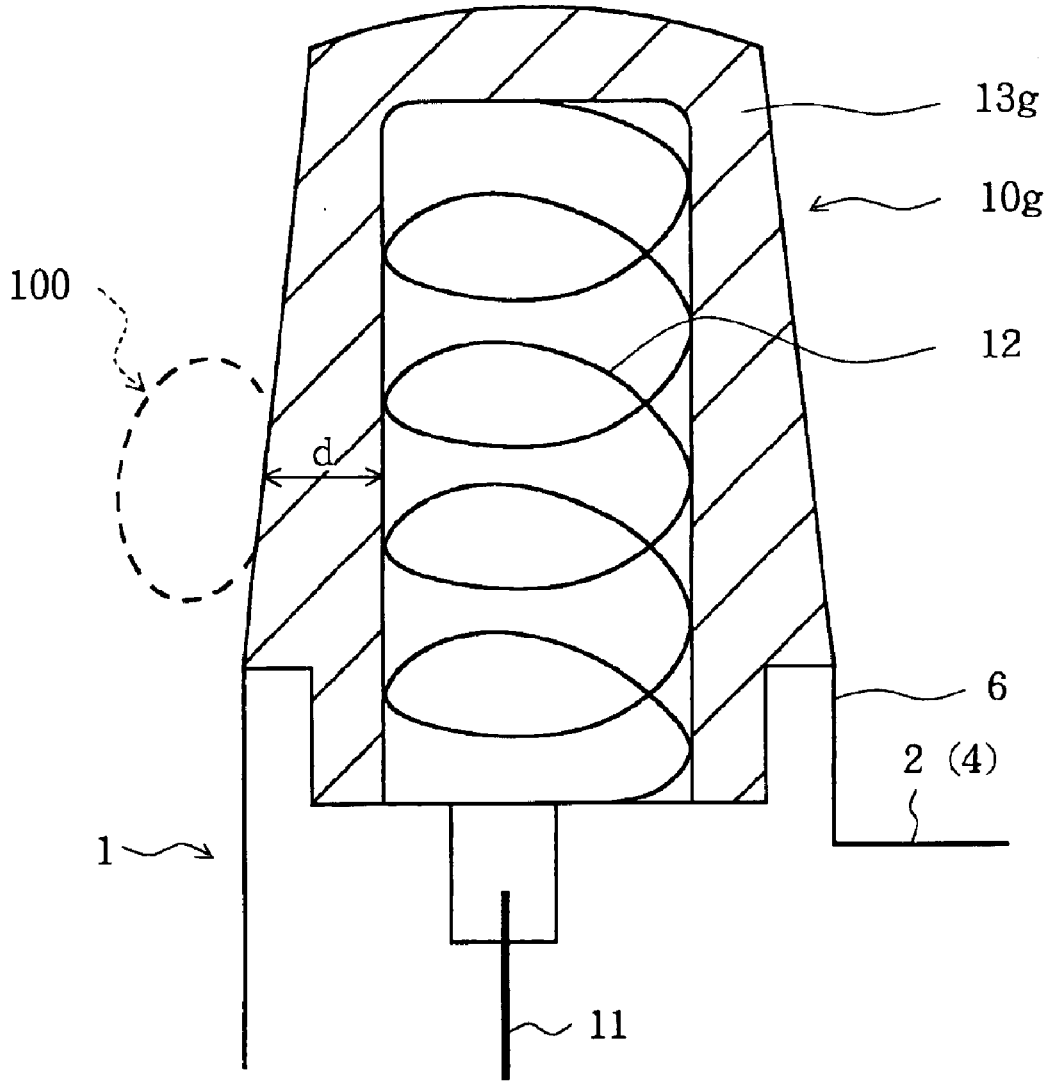
FIG. 9 is a cross-sectioned front view of a main portion of an antenna structure of mobile communication device according to a fifth embodiment of the present invention.

FIG. 9 is a cross-sectioned front view of a main portion of the antenna structure of the mobile communication device according to the fifth embodiment.

The antenna structure according to this embodiment is a modification of the first embodiment and a cap 13*g* of an antenna 10*g* thereof has a tapered outer peripheral surface to form a truncated cone with wall thickness thereof being increased toward a root of a helical antenna 12, as shown in FIG. 9.

The tapering is determined such that a distance d between an outer peripheral surface of the root portion of the cap 13*g* and a surface of the helical antenna 12 becomes 1.00 mm or more as in the case of the first embodiment, as shown.

In general, a finger 100, etc., of a user with which a key side casing portion 4 of a mobile communication device 1 is held is positioned on the side of the root of the antenna 10*g*.

Therefore, in this embodiment, the wall thickness of the cap 13*g* is not uniform and the cap is tapered such that the wall thickness is increased toward the root of the antenna 10*g*, which has a high possibility of touching of the finger 100, etc.

As such, according to the cap 13*g* of this embodiment, it is possible to set the wall thickness of the root portion of the cap 13*g* to at least 1.00 mm so that the desired distance d between the surface of the helical antenna 12 and the outer peripheral surface of the root portion of the cap 13*g* can be maintained.

Therefore, even if the finger of the user contacts with the outer peripheral surface of the cap 13*g*, variation of antenna pattern and/or antenna impedance can be restricted and electromagnetic wave is not blocked by the finger, so that it is possible to prevent antenna gain from being degraded and to obtain good antenna gain.

Further, by tapering the cap 13*f* in this manner, it is possible to reduce the weight of the cap 13*g*.

Further, according to the tapered configuration of the cap 13*g*, it is possible to reduce the outer diameter of the top portion of the antenna 10*g* to thereby improve the outer appearance of the antenna 10*g*. Therefore, it is possible to provide a more attractive antenna structure.

It should be noted that the antenna structure of mobile communication device and the mobile communication device having the same antenna structure, according to the present invention, are not limited to the described embodiments and can be modified in various manners within the scope of the present invention.

For example, although, in each of the described embodiments, the helical antenna has a helical element corresponding to one frequency, the helical antenna may be of a dual band type corresponding to two or more frequencies.

Although the casing structure of the mobile communication device having the described antenna structure, has been described as the foldable casing, other type casing than the foldable casing may be used. For example, a single casing structure may be used.

Further, although the antenna of the mobile communication device has been described as comprising the whip portion and the helical portion and arranged such that it extensible with respect to the casing thereof, the structure thereof is not limited to those described. For example, the present invention may be applied to an antenna having not an extensible rod portion but only a helical portion protruding from a casing thereof.

That is, the antenna structure of the present invention can be applied to a radio communication device having any antenna structure and any casing, provided that antenna gain can be improved by increasing a distance between an outer peripheral surface of an antenna protruding from a surface of a casing thereof and a surface of an antenna element arranged in the casing.

As described hereinbefore, according to the antenna structure of mobile communication device in which a large distance is provided between the antenna portion protruding from the casing thereof and the surface of the cap portion covering the antenna portion and the mobile communication device having the same antenna structure of the present invention, it is possible, even if a finger, etc., of a user contacts with the antenna portion, to separate the antenna portion from the finger by a constant distance or more.

Therefore, it becomes possible to restrict degradation of antenna gain due to influence of the finger, which is the conventional problem, to thereby obtain good antenna gain.

The present antenna structure is particularly suitable for use in a mobile telephone, etc., which has an antenna arranged in the vicinity of a hinge portion of a foldable casing, with which a user finger tends to contact.

What is claimed is:

1. An antenna structure for use in a mobile communication device, comprising:

an antenna, including a cylindrical helical antenna portion attached to an end of a whip antenna portion, protruding from a casing of said mobile communication device; and a cap for covering a surface of said cylindrical helical antenna portion and having a wall, said cap preventing antenna gain of said cylindrical helical antenna portion from being degraded due to a finger touch of a user by providing a distance between an outer peripheral surface of the wall of said cap and said surface of said cylindrical helical antenna portion of at least 1 mm, wherein the distance between said outer peripheral surface of said cap and said surface of said cylindrical helical antenna portion is increased by increasing a wall thickness of said cap, and wherein the wall of said cap is partially protruded by forming a plurality of irregularities of thickness of said cap along a length of said outer peripheral surface.

2. An antenna structure for use in a mobile communication device, comprising:

an antenna, including a cylindrical helical antenna portion attached to an end of a whip antenna portion, protruding from a casing of said mobile communication device; and a cap for covering a surface of said cylindrical helical antenna portion and having a wall, said cap preventing antenna gain of said cylindrical helical antenna portion from being degraded due to a finger touch of a user by providing a distance between an outer peripheral surface of the wall of said cap and said surface of said cylindrical helical antenna portion of at least 1 mm, wherein said cap is constructed with an inner cap covering said surface of said cylindrical helical antenna portion and an outer cap covering a portion or the whole portion of a surface of said inner cap.

3. An antenna structure for use in a mobile communication device, as claimed in claim 2, wherein said outer cap is detachably mounted on said inner cap.

4. A mobile communication device, comprising:

a portable casing and an antenna structure protruding externally of said casing to transmit and receive electromagnetic waves, said antenna structure comprising:

an antenna, including a cylindrical helical antenna portion attached to and end of a whip antenna portion, protruding from said casing of said mobile communication device; and a cap for covering a surface of said cylindrical helical antenna portion having a wall, said cap preventing antenna gain of said cylindrical helical antenna portion from being degraded due to a finger touch of a user by providing a distance between an outer peripheral surface of the wall of said cap and said surface of said cylindrical helical antenna portion of at least 1 mm;

wherein the distance between said outer peripheral surface of said cap and said surface of said cylindrical helical antenna portion is increased by increasing a wall thickness of said cap, and wherein the wall of said cap is partially protruded by forming a plurality of irregularities of thickness of said cap along a length of said outer peripheral surface.

5. A mobile communication device, comprising:

a portable casing and an antenna structure protruding externally of said casing to transmit and receive electromagnetic waves, said antenna structure comprising:

an antenna, including a cylindrical helical antenna portion attached to and end of a whip antenna portion, protruding from said casing of said mobile communication device; and a cap for covering a surface of said cylindrical helical antenna portion having a wall, said cap preventing antenna gain of said cylindrical helical antenna portion from being degraded due to a finger touch of a user by providing a distance between an outer peripheral surface of the wall of said cap and said surface of said cylindrical helical antenna portion of at least 1 mm;

wherein said cap is constructed with an inner cap covering said surface of said cylindrical helical antenna portion and an outer cap covering a portion or the whole portion of a surface of said inner cap.

6. A mobile communication device, as claimed in claim 5, wherein said outer cap is detachably mounted on said inner cap.

7. A mobile communication device comprising:

a foldable casing including a display side casing portion and a key side casing portion hinged to the display side casing portion, said display side casing including a liquid crystal display; and an antenna provided on a side of the key side casing portion and protruding therefrom, said antenna including a cylindrical helical antenna portion attached to an end of a whip antenna portion, wherein said whip antenna portion constitutes a portion of an extensible rod antenna housed in said key side casing portion of said foldable casing, and a cap for covering a surface of said cylindrical helical antenna portion and having a wall, said cap preventing antenna gain of said helical antenna portion from being degraded due to a finger touch of a user when said extensible rod antenna remains in a retracted position within said key side casing portion of said foldable casing by providing a distance between an outer peripheral surface of the wall of said cap and said surface of said cylindrical helical antenna portion of at least 1 mm.

8. An antenna structure for use in a mobile communication device, as claimed in claim 7, wherein the distance between said outer peripheral surface of said cap and said surface of said cylindrical helical antenna portion is increased by increasing a wall thickness of said cap.

9. An antenna structure for use in a mobile communication device, as claimed in claim 8, wherein the wall of said cap is partially protruded by forming a plurality of irregularities of thickness of said cap along a length of said outer peripheral surface.

10. An antenna structure for use in a mobile communication device, as claimed in claim 8, wherein said cap has a top portion and a root portion and the wall thickness of said cap is partially increased by tapering said cap to open toward a root portion of said cylindrical helical antenna portion.

11. An antenna structure for use in a mobile communication device, as claimed in claim 7, wherein the distance between said outer peripheral surface of said cap and said surface of said helical antenna portion is increased by providing a space between an inner peripheral surface of said cap and said surface of said cylindrical helical antenna portion.

12. An antenna structure for use in a mobile communication device, as claimed in claim 7, wherein said cap is constructed with an inner cap covering said surface of said cylindrical helical antenna portion and an outer cap covering a portion or the whole portion of a surface of said inner cap.

13. An antenna structure for use in a mobile communication device, as claimed in claim 12, wherein said outer cap is detachably mounted on said inner cap.

* * * * *